US009815062B2

(12) United States Patent
Cobb

(10) Patent No.: US 9,815,062 B2
(45) Date of Patent: Nov. 14, 2017

(54) REACTION VESSEL

(75) Inventor: Ben Cobb, Witlshire (GB)

(73) Assignee: Epistem Limited, Manchester (GB)

( * ) Notice: Subject to any disclaimer, the term of this patent is extended or adjusted under 35 U.S.C. 154(b) by 0 days.

(21) Appl. No.: 13/289,082

(22) Filed: Nov. 4, 2011

(65) Prior Publication Data

US 2012/0220024 A1 Aug. 30, 2012

(30) Foreign Application Priority Data

Nov. 4, 2010 (GB) ..... 1018624.5

(51) Int. Cl.

| | |
|---|---|
| ***B01L 9/06*** | (2006.01) |
| *B01L 3/00* | (2006.01) |
| *B01L 7/00* | (2006.01) |

(52) U.S. Cl.

CPC ..... *B01L 9/06* (2013.01); *B01L 3/5082* (2013.01); *B01L 3/50853* (2013.01); *B01L 3/50825* (2013.01); *B01L 3/50851* (2013.01); *B01L 3/50855* (2013.01); *B01L 7/52* (2013.01); *B01L 9/065* (2013.01); *B01L 2200/08* (2013.01); *B01L 2200/18* (2013.01); *B01L 2300/042* (2013.01); *B01L 2300/0654* (2013.01); *B01L 2300/0829* (2013.01); *B01L 2300/0838* (2013.01)

(58) Field of Classification Search

CPC ..... B01L 9/065; B01L 3/50825; B01L 9/06
See application file for complete search history.

(56) References Cited

U.S. PATENT DOCUMENTS

| | | | | | |
|---|---|---|---|---|---|
| 3,079,037 | A | * | 2/1963 | Schechter | B65D 43/021 215/393 |
| 3,941,858 | A | * | 3/1976 | Shepherd et al. | 523/120 |
| 4,348,207 | A | * | 9/1982 | Cappel | 436/510 |
| 5,005,721 | A | | 4/1991 | Jordan | |
| 5,392,914 | A | * | 2/1995 | Lemieux et al. | 206/499 |
| 5,406,856 | A | * | 4/1995 | Kuhn | 73/864.14 |
| 5,616,301 | A | | 4/1997 | Moser et al. | |
| 5,720,406 | A | | 2/1998 | Fassbind et al. | |
| 6,106,783 | A | * | 8/2000 | Gamble | 422/553 |
| 6,153,426 | A | | 11/2000 | Heimberg | |

(Continued)

FOREIGN PATENT DOCUMENTS

| | | | | |
|---|---|---|---|---|
| EP | 0404258 | * | 12/1990 | B01L 3/14 |
| EP | 1974818 | A1 | 10/2008 | |

(Continued)

OTHER PUBLICATIONS

International Search Report for PCT/GB2011/052126, 4 pages (dated Dec. 7, 2012).

*Primary Examiner* — Jonathan Hurst
(74) *Attorney, Agent, or Firm* — Choate, Hall & Stewart LLP; Brenda Herschbach Jarrell; Michael L. Vetter

(57) ABSTRACT

A reaction vessel assembly for use with thermal cyclers is described. The assembly includes a reaction vessel and a casing defining a cavity. In a first configuration, the casing receives the reaction vessel within the cavity, to act as a protective casing for the reaction vessel. In a second configuration, the casing engages with a mouth of the reaction vessel, to close the vessel. In this configuration, the casing may also act as a handle. In preferred embodiments, the reaction vessel is in the form of a capillary tube, and/or may include an integrated collimating lens. Certain embodiments also include an RFID tag.

20 Claims, 2 Drawing Sheets

(56) References Cited

U.S. PATENT DOCUMENTS

| | | | | |
|---|---|---|---|---|
| 6,340,589 | B1 * | 1/2002 | Turner et al. | 435/287.2 |
| 6,620,612 | B1 | 9/2003 | Bertling | |
| 7,306,767 | B2 * | 12/2007 | Mathus | B01L 3/50853 215/295 |
| 7,892,504 | B2 * | 2/2011 | Taike et al. | 422/562 |
| 2003/0044324 | A1 * | 3/2003 | Micklash et al. | 422/102 |
| 2005/0205673 | A1 * | 9/2005 | Morris et al. | 235/385 |
| 2007/0003443 | A1 * | 1/2007 | Sandell et al. | 422/100 |
| 2007/0017927 | A1 | 1/2007 | D'Amore et al. | |
| 2007/0031296 | A1 | 2/2007 | Coulling et al. | |
| 2007/0077648 | A1 | 4/2007 | Okamoto et al. | |
| 2008/0268506 | A1 | 10/2008 | Cobb | |
| 2010/0089850 | A1 | 4/2010 | Hovatter | |
| 2010/0192813 | A1 * | 8/2010 | Fry et al. | 108/57.31 |

FOREIGN PATENT DOCUMENTS

| | | | |
|---|---|---|---|
| EP | 2193845 | A1 | 6/2010 |
| JP | 2007/017441 | A | 1/2007 |
| JP | 2007/097477 | A | 4/2007 |
| JP | 2008/289473 | A | 12/2008 |
| WO | WO-2004/054715 | A1 | 7/2004 |
| WO | WO-2006/024879 | A1 | 3/2006 |
| WO | WO-2012/038750 | A1 | 3/2012 |

* cited by examiner

REACTION VESSEL

CROSS-REFERENCE TO RELATED APPLICATIONS

This patent application claims priority to Great Britain Application No. 1018624.5, filed Nov. 4, 2010, the disclosure of which is hereby incorporated in its entirety.

FIELD OF THE INVENTION

The present invention relates to a reaction vessel assembly for use primarily, but not exclusively, with thermal cyclers, such as those used for polymerase chain reaction (PCR) amplification of nucleic acids.

BACKGROUND TO THE INVENTION

Thermal cycling applications are an integral part of contemporary molecular biology. For example, the polymerase chain reaction (PCR), which is used to amplify nucleic acids, uses a series of DNA melting, annealing, and polymerisation steps at different temperatures to greatly amplify the amount of DNA in a sample. Conventional PCR reactions proceed in a closed vessel, with amplification being confirmed by extracting a sample from the finished reaction and analysing the product by gel electrophoresis.

This conventional analysis technique requires that the user wait until the cycling has finished before being able to confirm that amplification is taking place; this can lead to delays in obtaining experimental data, for example when a cycling reaction must be repeated due to failure of amplification. For this reason, alternative methods of analysing PCR and other amplification products have been developed which may be used to measure amplification at an earlier stage of the reaction. One such technique involves the incorporation of fluorescently labelled nucleotides into the reaction; as the DNA is amplified, so the intensity of fluorescence will increase. Detecting this fluorescence during the reaction can give a real-time indication of the progress of amplification. Many other molecular biology techniques make use of optical measurements to determine the progress of a reaction; for example, optical absorbance of a particular wavelength.

Measurement of fluorescence or other optical properties during progress of a reaction presents particular problems for the design of instrumentation and consumables. Conventional PCR reaction vessels are in the form of individual vessels having uniformly tapered conical portions, or take a multi-well plate format. Such vessels can present a relatively large cross section to illuminating and emitted light, so reducing the intensity of light able to be received at a detector. Further, the conical portions of such vessels enclose a relatively high volume of reaction mix, which therefore has a high thermal lag, leading to longer cycle times. Reduction in the volume of reaction mix can reduce this difficulty, but will reduce the amount of fluorescence produced by the reaction, so requiring more sensitive detectors. It is also necessary to include complex optical components in the thermal cycler to gather light emitted from the reaction vessel, and to reduce the effects of misalignment of the vessel and the light detector.

The effect of thermal lag is also exacerbated by the thickness of the reaction vessel walls. Thin walled vessels are available, having walls down to around 0.5 mm thick, but limits on injection moulding technology tend to prevent conventional reaction vessels being produced having substantially thinner walls.

Reaction vessels may be produced in the form of capillary tubes, but these require careful handling and transport to prevent unwanted damage to the vessel.

Various types of reaction vessels with removable lids have been described. For example, U.S. Pat. No. 5,720,406 describes a removable cover with a handle. U.S. Pat. No. 5,616,301 describes a holder for reaction vessels. U.S. Pat. No. 6,153,426 describes a thermal cycling apparatus with an integrated cover for closing reaction vessels. U.S. Pat. No. 6,620,612 describes a cover to be urged against a reaction vessel. EP 1 974 818 describes a cover affixable to a reaction vessel by heat sealing. U.S. Pat. No. 5,005,721 describes a vial seal which includes openings for securing the seal to a number of vials when the seal is open. WO 2006/024879 describes a thin walled reaction vessel with a generally flattened profile.

Embodiments of the present invention are intended to provide an alternative reaction vessel particularly suited for use in thermal cycling reactions.

SUMMARY OF THE INVENTION

According to a first aspect of the present invention, there is provided a reaction vessel assembly for use in a thermal cycling reaction, the assembly comprising at least one reaction vessel having a mouth, a body, and a tip; and a casing defining a cavity having an opening, the casing further having an engaging surface; wherein in a first configuration the reaction vessel is received within the cavity of the casing via the opening, and in a second configuration the engaging surface of the casing engages with the mouth of the reaction vessel to close the mouth.

Thus, the casing can act as a protective casing in the first configuration, to avoid or reduce damage to the reaction vessel during handling and transport; while in the second configuration the casing acts as a lid to seal the mouth of the reaction vessel, so preventing spillage and evaporation.

The casing may also act as a handle for the user to manipulate and transfer the reaction vessels; to this end, in certain embodiments of the invention the casing may include finger grips, recesses, or other formations adapted to be grasped by a user. Using the casing as a handle also avoids the need for a user to touch the reaction vessel directly, which may lead to unwanted changes in temperature, as well as increased risk of contamination of the contents.

Preferably the assembly comprises a plurality of reaction vessels; in a particularly preferred embodiment there are three reaction vessels, although different numbers may be used. The plurality of reaction vessels are preferably joined, for example as a strip or as a multiwell plate.

The reaction vessel or vessels are preferably elongate, and the casing is sized and shaped accordingly. The opening of the casing is preferably on a first portion of the casing, and the engaging surface is preferably on an opposed second portion of the casing; for example, the opening and the engaging surface may be on top and bottom portions of the casing respectively.

In the first configuration, preferably the mouth of the reaction vessel is aligned with the opening of the casing such that the reaction vessel is open to allow a user access to the interior of the reaction vessel. This allows reagents to be added to or removed from the reaction vessel while it is protected by the casing.

Preferably the body of the reaction vessel is in the form of a capillary tube; this allows for low volumes of reagents to be used, reducing cycling times.

Preferably the mouth of the reaction vessel is of a greater diameter than the body.

The tip of the reaction vessel preferably comprises an integrated collimating lens. The lens may be a positive meniscus lens. A positive (or convergent) meniscus lens is a convex-concave lens thicker at the centre than at the edges. Other forms of collimating lenses may be used (for example, a Fresnel lens), but a positive meniscus lens is preferred. The presence of a collimating lens ensures that any light generated within the reaction vessel will be collimated, and provides a uniform light and an image at the photodiode or other light detecting means of a thermal cycler that is representative of fluorescence along the entire length of the reaction vessel. Because the light is collimated, the light detection mechanism of the thermal cycler can be more tolerant of misalignment or other small variations in reaction vessel position with respect to the mechanism. This means both that manufacturing tolerances can be greater, and that it is not necessary to include complex optical arrangements in the thermal cycler to compensate for such misalignment. Further, integration of the collimating lens in the reaction vessel, rather than providing a separate lens assembly in the thermal cycler, again reduces manufacturing complexity of the thermal cycler, and avoids the need for alignment of the reaction vessel with the separate lens assembly. An integrated lens is also generally relatively inexpensive to produce, particularly when the reaction vessel and lens are produced from a plastics material.

Preferably the reaction vessel is produced from a plastics material, more preferably a hydrophilic polymer. A preferred material is polycarbonate, such as that sold under the brand name Makrolon®. The use of a hydrophilic polymer allows the tube to be held in a generally horizontal position when in the thermal cycler without spillage. Certain thermal cyclers—for example, that described in applicant's co-pending patent application GB1016014.1, or the corresponding application PCT/GB2011/051787—are designed to hold reaction vessels in a generally horizontal orientation when cycling. Other suitable materials include any suitable optically transparent material; for example, glass, topaz, polystyrene.

The engaging surface of the casing may be provided with an elastomeric gasket, to ensure an airtight fit between the engaging surface and the reaction vessel. The gasket may be made of any suitable material, particularly preferred are rubber, santoprene, PTFE, and the like.

Preferably the engaging surface of the casing has one or more protrusions sized and shaped to fit within the mouth portion of the reaction vessel. The number of protrusions will generally correspond to the number of reaction vessels. The protrusion preferably forms an interference fit with the reaction vessel, when in the second configuration. This creates a tight seal on the reaction vessel, and allows the vessels to be manipulated by handling the casing, as well as reducing evaporation of the contents of the reaction vessel. The protrusion also increases the pressure within the reaction vessel when engaged, so further reducing evaporation.

Preferably the protrusion extends into the mouth of the reaction vessel; in the most preferred embodiment, the protrusion substantially fills the mouth of the reaction vessel.

The engaging surface of the casing may also have one or more detents or other features designed to engage with the outer surface of the reaction vessel, when in the second configuration. This can assist in retaining the casing on the reaction vessel.

The opening of the casing may also include one or more detents or other features designed to engage with the outer surface of the reaction vessel, when in the first configuration.

The reaction vessel may also include a detent or other formation designed to engage with a portion of the casing; for example, the reaction vessel may include a lip formed adjacent the mouth which engages with the opening of the casing in the first configuration.

The assembly may further comprise an RFID tag or other marker. The RFID tag may be provided on the reaction vessel, or on the casing. The tag may be embedded in the vessel or casing, or may be provided on a label. The RFID tag may be configured to include information selected to allow a RFID tag reader to identify the particular assembly, or to allow a reader to determine the intended use of the assembly. For example, the information may reference the assembly to a particular device (eg, a thermal cycler) and/or to confirm any or all of the type of test, the lot and expiry date, or the peak position of a positive result. The tag may have the capability of a read/write flag to indicate if the assembly has previously been used, preferably including the option to save the result. The data may be saved as a small xml string, or other text string that may or may not be encrypted. In use, a thermal cycler may read the information recorded on the RFID tag, and select an appropriate operating program to perform the desired test (eg, PCR cycle times, and fluorescence detection), without the need for a user to manually program the thermal cycler. Similarly, the cycler may confirm that the expiry date has not passed, and alert the operator if it has done.

According to a further aspect of the present invention, there is provided a reaction vessel array for use in a thermal cycling reaction, the array comprising a plurality of reaction vessels each having a mouth, a body, and a tip; wherein the tip of the reaction vessel comprises an integrated collimating lens.

The lens may be a positive meniscus lens. A positive (or convergent) meniscus lens is a convex-concave lens thicker at the centre than at the edges. Other forms of collimating lenses may be used (for example, a Fresnel lens), but a positive meniscus lens is preferred. The presence of a collimating lens ensures that any light generated within the reaction vessel will be collimated, and provides a uniform light and an image at the photodiode or other light detecting means of a thermal cycler that is representative of fluorescence along the entire length of the reaction vessel. Because the light is collimated, the light detection mechanism of the thermal cycler can be more tolerant of misalignment or other small variations in reaction vessel position with respect to the mechanism. This means both that manufacturing tolerances can be greater, and that it is not necessary to include complex optical arrangements in the thermal cycler to compensate for such misalignment. Further, integration of the collimating lens in the reaction vessel, rather than providing a separate lens assembly in the thermal cycler, again reduces manufacturing complexity of the thermal cycler, and avoids the need for alignment of the reaction vessel with the separate lens assembly. An integrated lens is also generally relatively inexpensive to produce, particularly when the reaction vessel and lens are produced from a plastics material.

The array may further comprise an RFID tag or other marker. The tag may be embedded in the array, or may be provided on a label. The RFID tag may be configured to include information selected to allow a RFID tag reader to identify the particular array, or to allow a reader to determine the intended use of the array. For example, the information may reference the array to a particular device (eg, a thermal cycler) and/or to confirm any or all of the type of test to be carried out on the contents of the array, the lot and expiry date, or the peak position (eg, frequency of emitted fluorescence) of a positive result. The tag may have the capability of a read/write flag to indicate if the array has previously been used, preferably including the option to save the result. The data may be saved as a small xml string, or other text string that may or may not be encrypted.

BRIEF SUMMARY OF THE DRAWINGS

These and other aspects of the invention will now be described by way of example only with reference to the accompanying drawings, in which.

DETAILED DESCRIPTION OF THE DRAWINGS

Figure 1:
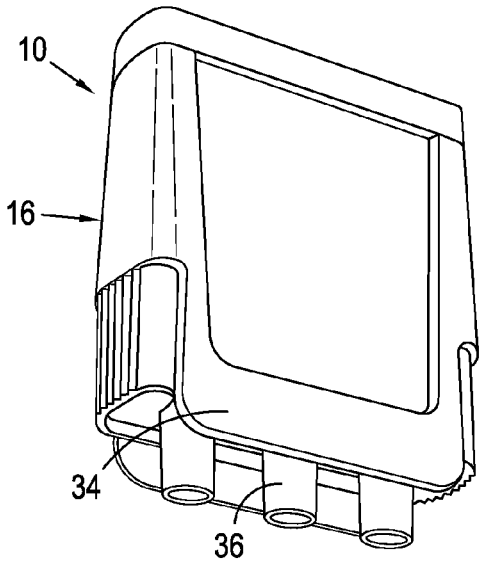
FIG. 1 shows a reaction vessel assembly in accordance with an embodiment of the present invention in a first configuration.
Figure 2:
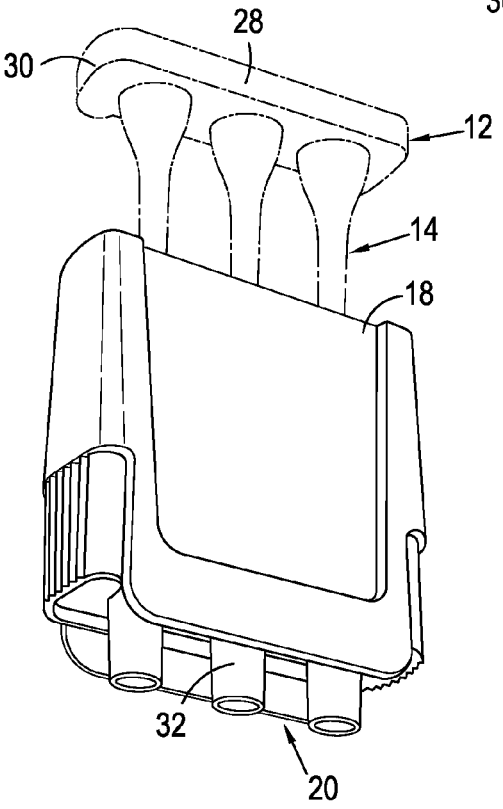
FIG. 2 shows the reaction vessel assembly of FIG. 1 moving towards the second configuration.
Figure 3:
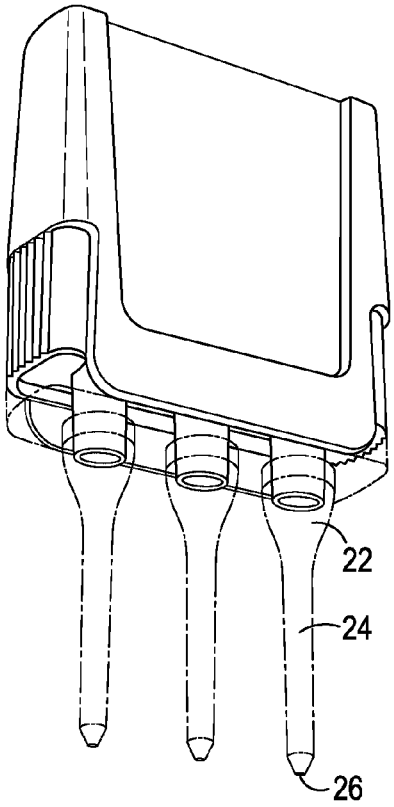
FIG. 3 shows the reaction vessel assembly of FIG. 1 in a second configuration.

Referring to FIGS. 1 to 3, these show different views of a reaction vessel assembly 10 in accordance with an embodiment of the present invention. The assembly 10 comprises a reaction vessel array 12 which includes three reaction vessels 14 joined in a strip. The assembly 10 also includes a casing 16, which has an opening 18 for receiving reaction vessels 14, and an engaging surface 20 opposed to the opening 18.

Each reaction vessel 14 includes a wide mouth 22, a narrow elongate body 24, and a tip 26. The three reaction vessels 14 making up the strip are joined at the mouths 22 by a connecting piece 28 which includes a lip 30.

On the engaging surface 20 of the casing 16 are provided three protrusions 32, which are sized, shaped, and located so as to align with the mouths 22 of the reaction vessels 14 when in an appropriate configuration. The engaging surface 20 is partially enclosed by a raised edge 34, on which are located a series of detents 36.

Figure 4:
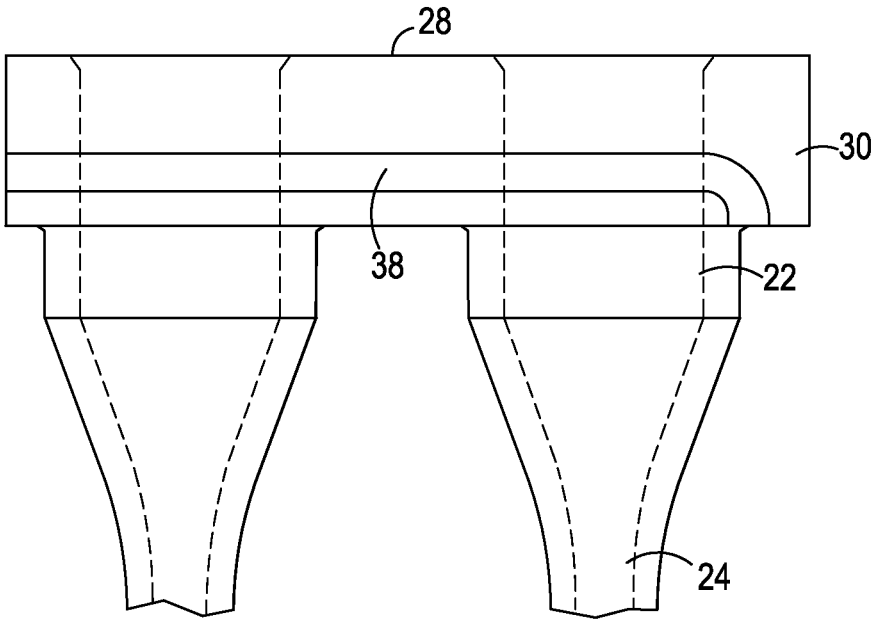
FIG. 4 shows a close up view of the reaction vessels of the assembly of FIG. 1.

FIG. 4 shows an enlarged view of a portion of the reaction vessel array 12. As can be seen clearly in this figure, the lip 30 of the connecting piece 28 is formed with an internal raised bead 38 extending along the length of the lip 30. This is paralleled by an external groove overlaying the raised bead. The Figure also shows that the body 24 of the reaction vessel is relatively narrow; it may be a capillary tube type. The mouth 22 is much wider, perhaps three times wider, than the body 24. The reaction vessel array is formed from moulded polycarbonate; for example, Makrolon®.

Figure 5:
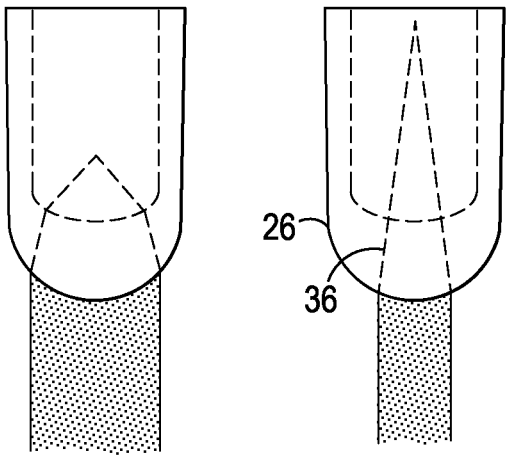
FIG. 5 shows a view of the tip of one of the reaction vessels of FIG. 4.

The tip 26 of the reaction vessel is shown in more detail in FIG. 5. The tip is moulded so as to form a positive meniscus lens at the tip of the vessel. This serves to collimate light generated by a sample in the vessel, so as to provide a uniform light exiting the tip of the vessel. The collimated light is representative of fluorescence along the entire length of the sample. This negates the need for external lensing which can be expensive, and allows the photodiodes of the thermal cycler to be placed closer to the tube, increasing sensitivity and enabling the use of low cost, less sensitive photodiodes. Most other optical assemblies have expensive dichroic mirrors and complex optical pathways. The simplicity of optics lowers the cost of the instrument. Further benefits arise from the fact that there is only one alignment requirement, that of the tube in the sample block, and no chance of misalignment of optical components. This allows portability and robustness of a thermal cycler.

Producing the reaction vessel from moulded polycarbonate means that forming a positive meniscus lens is relatively straightforward. Mould venting may be above the lens; this is further improved by the having a slightly smaller aperture at the base of the tube. The lens enables more plastic to accumulate at the bottom providing easier moulding, again venting can occur forward of the tip to provide witness lines that do not interfere with the optical signal. This enables a thin wall section of 0.25-0.35 mm, which provides better thermal performance and improved dynamics and uniformity of sample heating.

The reaction vessel assembly may be used as follows. FIG. 1 shows a first configuration of the assembly—the reaction vessel array 12 is placed within the opening 18 of the casing 16. The raised bead 38 on the lip 30 of the array 12 engages with the edge of the casing 16 to hold the array 12 and the casing 16 together in an interference fit. In this configuration, the reaction vessel array is protected from damage and contamination by the casing 16, and the whole assembly may be carried and transported by holding only the casing 16. Samples may be loaded into the reaction vessels 14 while in the first configuration; the casing prevents or reduces heat transfer from handling.

Once the samples have been loaded, the user may remove the reaction vessel array 12 from the casing 16—FIG. 2—and place the assembly in a second configuration—FIG. 3. In this configuration, the array 12 is placed on the mounting surface 20 of the casing. The protrusions 32 fit snugly within the mouths 22 of the reaction vessels. This forms an interference fit which serves, at least in part, to retain the array 12 on the casing 16. The shape of the mouths 22 of the vessels allows the protrusions 32 to fill most of the void above the body 24 of the vessel; this minimises loss of sample due to evaporation. The arrangement also raises the pressure within the vessel, again reducing evaporation. Coupled with the hydrophilic properties of the polycarbonate material used to make the vessel, this limits sample loss at the interface. Further, the capillary tube nature of the body, together with the tight fit of the protrusions in the mouths and the hydrophilic material, allows the filled reaction vessels to be held substantially horizontally during cycling without loss of sample.

When in the second configuration, the detents 36 on the casing 16 engage with the groove 38 on the reaction vessel array to hold the casing in place.

In this second configuration, the casing 16 may be used as a handle to hold and manipulate the reaction vessels, again without the need to touch the vessels directly. The user may hold the casing 16 and insert the assembly into a thermal cycler for carrying out reactions on the sample. Typically these reactions will involve samples generating fluorescence; as has been already discussed, the collimating lens in the tip of the reaction vessels serves to collimate any emitted light from the sample; this can then be detected by photodiodes or other suitable sensors in the thermal cycler.

The foregoing is described by way of example only, and the skilled person will be aware of other variations to the described embodiment which may be made.

The invention claimed is:

1. A reaction vessel assembly for use in a thermal cycling reaction, the assembly comprising:

(a) one or more reaction vessels, each comprising:

i. a mouth, ii. a body, and iii. a sealed tip; and (b) a casing comprising:

i. a cavity with an opening for receiving the one or more reaction vessels, and ii. an engaging surface opposed to the opening, which engaging surface comprises one or more protrusions extending therefrom;

the reaction vessel assembly arranged and configured such that in a first configuration the one or more reaction vessels are received within the cavity of the casing via the opening, and in a second configuration the one or more reaction vessels are not within the cavity and the mouth of each one or more reaction vessels is engaged with one of the protrusions extending from the engaging surface so that the protrusion extends into the reaction vessel, forming an interference fit therewith so that the one or more reaction vessels is retained on the casing and its mouth is closed, whereby the protrusion acts as a lid to seal the mouth, in a manner that minimizes evaporation from the reaction vessel and allows the reaction vessel to be held substantially horizontally during cycling without loss of sample, wherein the body of each of the reaction vessels is elongate and wherein in the first configuration the casing encases the full-length of the body of each of the reaction vessels.

2. The assembly of claim 1, wherein the casing further comprises formations adapted to be grasped by a user selected from the group consisting of finger grips, recesses, and combinations thereof.

3. The assembly of claim 1, wherein the one or more reaction vessels are connected to one another independent of the casing.

4. The assembly of claim 1, wherein the opening of the casing is on a first portion of the casing, and the engaging surface is on an opposed second portion of the casing.

5. The assembly of claim 1, wherein in the first configuration the mouth of each one or more reaction vessel is aligned with the opening of the casing such that the reaction vessel is open to allow a user access to the interior of the reaction vessel.

6. The assembly of claim 1, wherein the body of the reaction vessel is in the form of a capillary tube.

7. The assembly of claim 1, wherein the mouth of the reaction vessel is of a greater diameter than the body.

8. The assembly of claim 1, wherein the tip of the reaction vessel comprises an integrated collimating lens.

9. The assembly of claim 8 wherein the collimating lens is selected from the group consisting of a positive meniscus lens, convergent meniscus lens and a Fresnel lens.

10. The assembly of claim 1, wherein the reaction vessel is produced from a hydrophilic polymer.

11. The assembly of claim 1, wherein the engaging surface of the casing has one or more protrusions sized and shaped to fit within the mouth of the reaction vessel.

12. The assembly of claim 11, wherein in the second configuration the protrusion substantially fills the mouth of the reaction vessel.

13. The assembly of claim 1, wherein the engaging surface of the casing includes one or more detents designed to engage with an outer surface of the reaction vessel, when in the second configuration.

14. The assembly of claim 1, wherein the opening of the casing includes one or more detents designed to engage with an outer surface of the reaction vessel, when in the first configuration.

15. The assembly of claim 1, wherein the reaction vessel includes one or more detents designed to engage with a portion of the casing.

16. The assembly of claim 1, wherein the engaging surface of the casing comprises an elastomeric gasket selected from the group consisting of rubber, santoprene, polytetrafluoroethylene (PTFE) and combinations thereof.

17. The assembly of claim 1, further comprising an RFID tag.

18. The assembly of claim 3, further comprising a connecting piece, wherein the one or more reactions vessels are connected to each other via attachment to the connecting piece by their respective mouths.

19. The assembly of claim 1, wherein the casing has an edge; and the one or more reaction vessels are part of an array, which array comprises a lip arranged and constructed so that, in the first configuration, the lip engages the edge of the casing to hold the array and the casing together.

20. The assembly of claim 19, wherein the lip comprises a raised bead.

* * * * *